US007114200B1

(12) United States Patent
Bennett

(10) Patent No.: US 7,114,200 B1
(45) Date of Patent: Oct. 3, 2006

(54) POOL AND BATHTUB CUSHION

(76) Inventor: Layla K. Bennett, 21 Oyster Pond La., East Hampton, NY (US) 11937

( * ) Notice: Subject to any disclaimer, the term of this patent is extended or adjusted under 35 U.S.C. 154(b) by 0 days.

(21) Appl. No.: 11/087,656

(22) Filed: Mar. 24, 2005

(51) Int. Cl.
*E04H 4/00* (2006.01)

(52) U.S. Cl. ..... 4/504; 4/580; 4/657; 4/DIG. 18

(58) Field of Classification Search ..... 4/504, 4/580–583, 657, DIG. 18; 5/413 AM, 655.3, 5/710

See application file for complete search history.

(56) References Cited

U.S. PATENT DOCUMENTS

| | | | | |
|---|---|---|---|---|
| 2,152,968 | A | 4/1939 | Monge | |
| 3,351,958 | A | 11/1967 | Shields | |
| 3,628,198 | A | 12/1971 | Katzman | |
| 3,835,481 | A | 9/1974 | Engelhart et al. | |
| 4,937,897 | A | 7/1990 | Barnabie | |
| 5,134,730 | A | 8/1992 | Vandis | |
| 5,421,041 | A | 6/1995 | Stern | |
| 5,423,093 | A | 6/1995 | Hall-Vandis | |
| 5,678,254 | A | 10/1997 | Jardim | |
| 5,715,546 | A | 2/1998 | Kvalvik | |
| 5,771,506 | A * | 6/1998 | Joiner | 4/575.1 |
| 6,453,485 | B1 | 9/2002 | Bullock | |
| 6,675,402 | B1 | 1/2004 | Maurer | |
| 6,925,660 | B1 * | 8/2005 | Cartwright | 4/523 |
| 2001/0034907 | A1 | 11/2001 | Bullock | |

* cited by examiner

*Primary Examiner*—Huyen Le
(74) *Attorney, Agent, or Firm*—Richard C. Litman

(57) ABSTRACT

The pool and bathtub cushion is a padded mat for protecting against injuries that are often sustained against pool or bathtub edges. A first end of the pool cushion is secured outside of the pool through the use of fasteners or weights and the second end is secured to the interior vertical pool wall through the use of suction cups. A middle section of the cushion contains a cavity that is filled with a pliable structural support member, such as wire mesh. The cushion is placed over the edge of the swimming pool so that the support member completely encompasses the swimming pool edge. The support member allows the cushion to conform to an edge of any shape. The bathtub cushion is the same, but with suction cups along both ends of the cushion for attachment to the tub wall.

16 Claims, 5 Drawing Sheets

POOL AND BATHTUB CUSHION

BACKGROUND OF THE INVENTION

1. Field of the Invention

The present invention relates to cushioning devices, and more specifically, to a pool cushion and a bathtub cushion used to cushion sharp edges on swimming pools and bathtubs.

2. Description of the Related Art

It is very common for children, and even adults, to scrape parts of their body when engaging the edge of a swimming pool. Swimmers will often attempt to climb out of a swimming pool using the edge of the pool for support. In doing so, it is commonplace for swimmers to scratch and abrade arms, legs, and other body parts. It is likewise not uncommon for swimmers to accidentally impact a portion of their body into the edge of the pool. Chipping of a tooth and head injuries oftentimes can result from any inadvertence in attempting to climb out of a swimming pool, or while playing or swimming adjacent to the edge.

Similarly, many people slip and fall in their bathtubs, causing injuries and even death. One of the most dangerous surfaces to fall upon in a bathtub is the edge of the bathtub. The edge of the bathtub projects upwardly and is relatively narrow and, therefore, contains clearly defined edges that can cause severe injury when struck.

Swimming pool and bathtub edges come in many designs, including varying heights, widths, lengths, and contours. Accordingly, there is a need for a cushioning device that can easily configure to a swimming pool or bathtub of any shape.

Thus, a pool and bathtub cushion solving the aforementioned problems is desired.

SUMMARY OF THE INVENTION

The pool cushion for cushioning a swimming pool edge is a padded mat having a first end adapted to retain the device in a fixed position along the periphery of the pool, a second end affixed to the interior wall of the pool, a top surface, a bottom surface, a cavity between the top surface and the bottom surface and extending substantially the entire width of the device, and a pliable structural support member within the cavity. The pool cushion is placed over the edge of the swimming pool so that the padding completely encompasses the swimming pool edge. The structural support member includes a wire mesh disposed in the cavity so that the cushion has sufficient rigidity to conform to the edge of the pool. The cushion may include additional padding within the cavity along the central portion of the cushion that folds over the swimming pool edge, or the cushion may be made with an extra layer of thickness of the padded material along the central portion. The cushion is constructed from a resilient material, such as rubber or foam rubber.

A first end of the cushion adapted for securing the cushion around the periphery of the pool. For example, the first end may have apertures that allow flat stake inserts, hooks, or fasteners, such as bolts or screws, to be used to secure the cushion into the pool deck or area around the pool. Alternatively, the first end may be equipped with a hollowed out channel extending along the entire width of the cushion between the top and bottom surfaces. The channel can be filled with a densely weighted material, allowing the cushion to be weighted down in place along the periphery of the swimming pool.

The second end of the cushion is secured to the inside wall of the swimming pool. The second end may be attached so that its leading edge is either above or below the water level of the pool. Preferably, a series of suction cups extend from the bottom surface of the cushion near the second end, allowing the second end to be secured in place along the inside wall of the swimming pool.

In addition, a plurality of cushions can be placed end-to-end to cover an entire edge of a swimming pool. The cushions can come in varying widths and can be equipped with interlocking configurations at each end so that a series of the cushions can be secured to one another around the entire circumference of the pool. Linear and curved sections can be combined to provide a neat and finished look around the entire edge portion of the swimming pool.

It is also possible for the cushion to be adapted for use on a bathtub edge. The bathtub cushion is essentially identical to the pool cushion, except that suction cups are provided at the first end for attaching the cushion to the tub.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a cushion for use on swimming pool and bathtub edges.

Figure 1:
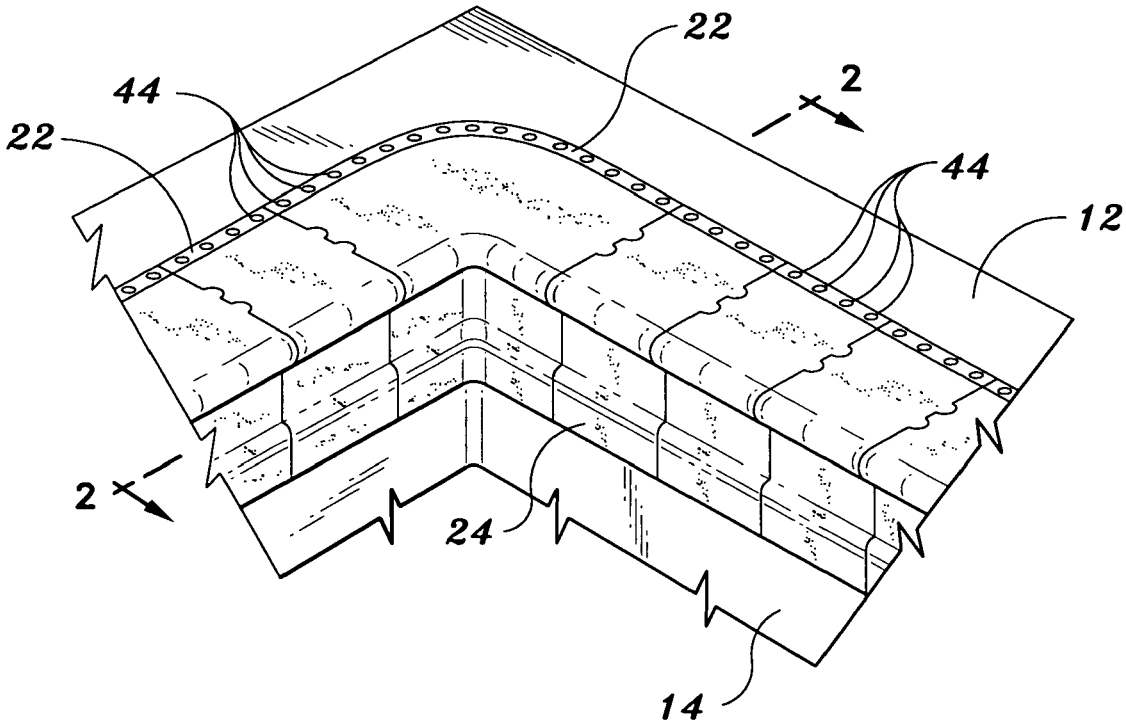
FIG. 1 is an environmental perspective view of a plurality of pool cushions according to the present invention disposed about an interior corner of a swimming pool.
Figure 2:
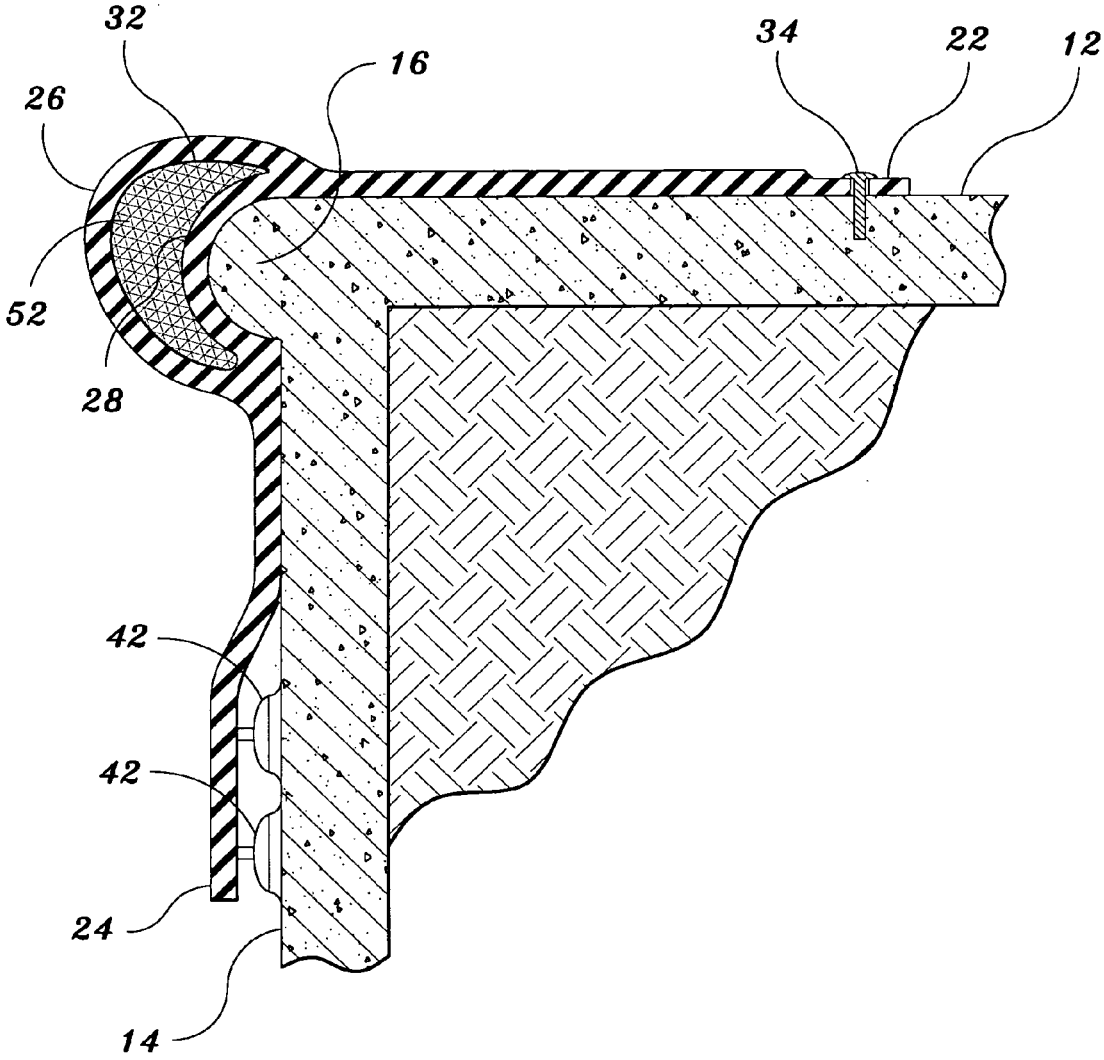
FIG. 2 is an environmental vertical sectional view showing a pool cushion of the present invention disposed over an edge of a swimming pool.

FIGS. 1 and 2 show an embodiment of the present invention in which the cushion is being used to protect the edge of a swimming pool. The swimming pool has an upper deck surface 12 and a vertically disposed interior pool wall 14. The swimming pool is provided with a rounded bead-like edge 16, located at the intersection of upper deck surface 12 and interior pool wall 14. The cushion is a padded mat having a first end 22 that is provided with a plurality of apertures 44. The apertures 44 allow of plurality of fasteners 34 to be used to secure the cushion to the pool deck through the upper deck surface 12. It will be understood that the first end 22 may be secured in any of a variety of ways, including providing the bottom surface with a heavy rubber base having a high coefficient of friction, by using a plurality of small flat stake inserts with covers, by suction cups, by hooks, or by fasteners 34, such as bolts or screws.

The cushion has a top surface 26 and a bottom surface 28. A cavity 32 is created within the cushion between top surface 26 and bottom surface 28 and extends along substantially the entire width of the cushion. Cavity 32 is filled with a pliable structural support member 52. The cushion is placed over the edge 16 of the swimming pool so that the portion of the cushion enclosing structural support member 52 completely encompasses swimming pool edge 16. The pliable structural support member 52, preferably a wire mesh, allows the cushion to conform to any shaped edge. Additional padding material may be disposed in the cavity, if desired, for additional cushioning above the beaded edge 16.

The cushion has a second end 24 that is provided with a plurality of suction cups 42 extending from the bottom surface 28 of the cushion. Suction cups 42 are used to secure the second end 24 of the cushion to interior pool wall 14.

Figure 4:
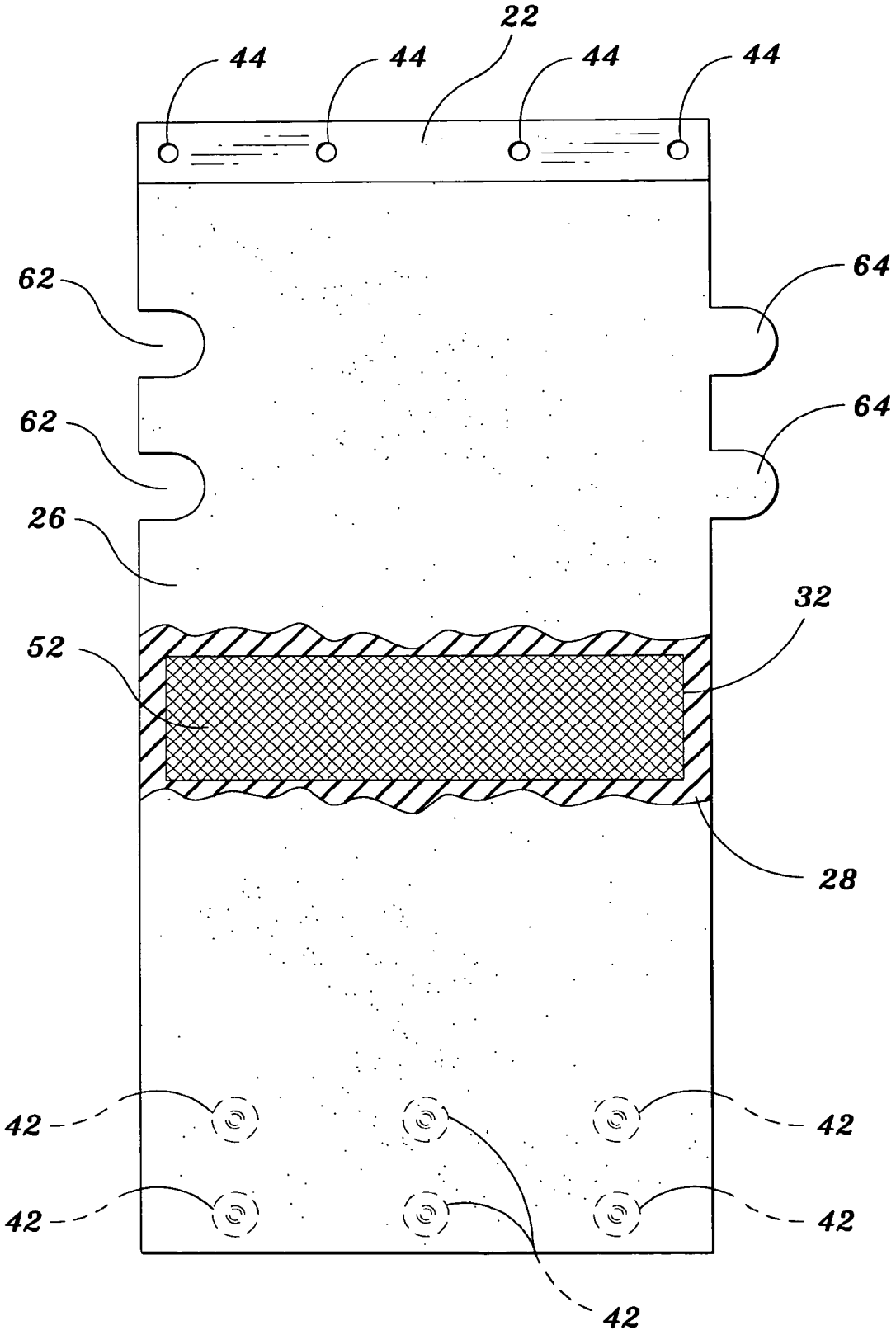
FIG. 4 is a top plan view of a pool cushion of the present invention with a portion of the top surface broken away and in section, exposing the cavity and the pliable filling material within the cavity.

A plurality of cushions can be used together in order to completely cover the entire edge 16 of the swimming pool. As shown in FIGS. 1 and 4, each cushion is equipped with a series of notches 62 on one side along the portion of the cushion that is adjacent to upper deck surface 12. The opposite side of each cushion is equipped with a series of protrusions 64 that correspond to notches 62 so that multiple cushions can be interlocked together. The cushions can be produced in a variety of widths and can have a generally linear or curved shape, so that multiple cushions can be combined to provide a neat and finished look around the entire edge portion of the swimming pool and peripheral area.

Figure 3:
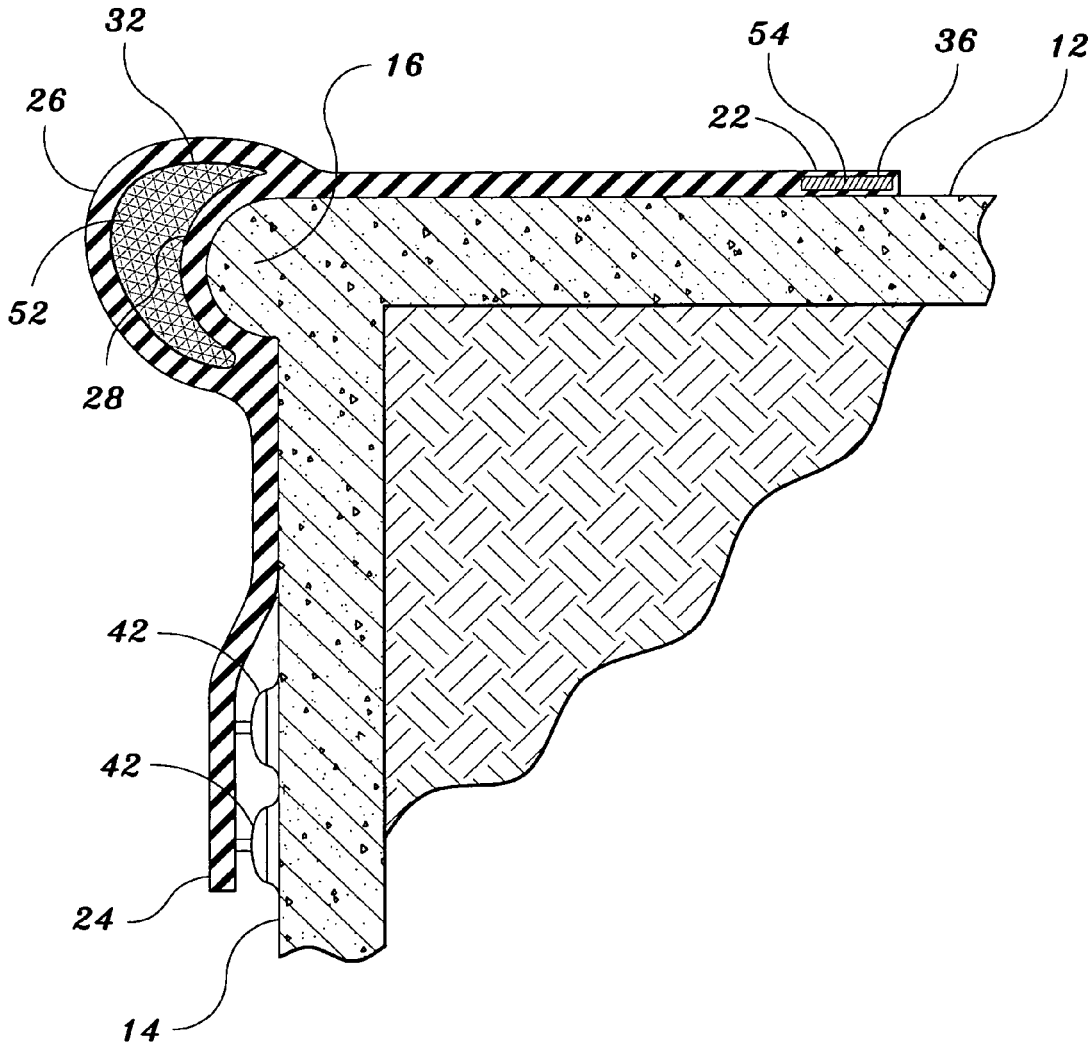
FIG. 3 is an environmental vertical sectional view of a pool cushion of the present invention similar to FIG. 2, showing an alternative means of securing the cushion along the pool periphery.

FIG. 3 shows an alternate embodiment of the cushion as used for a swimming pool edge 16 wherein the first end 22 of the cushion is secured along the upper deck surface 12 through an alternative structure. In this embodiment, a second cavity 36 is created within the cushion extending along substantially the entire width of the cushion between top surface 26 and bottom surface 28. Second cavity 36 is filled with a densely weighted material 54, so that the cushion is weighted down in place along the periphery of the swimming pool.

Figure 5:
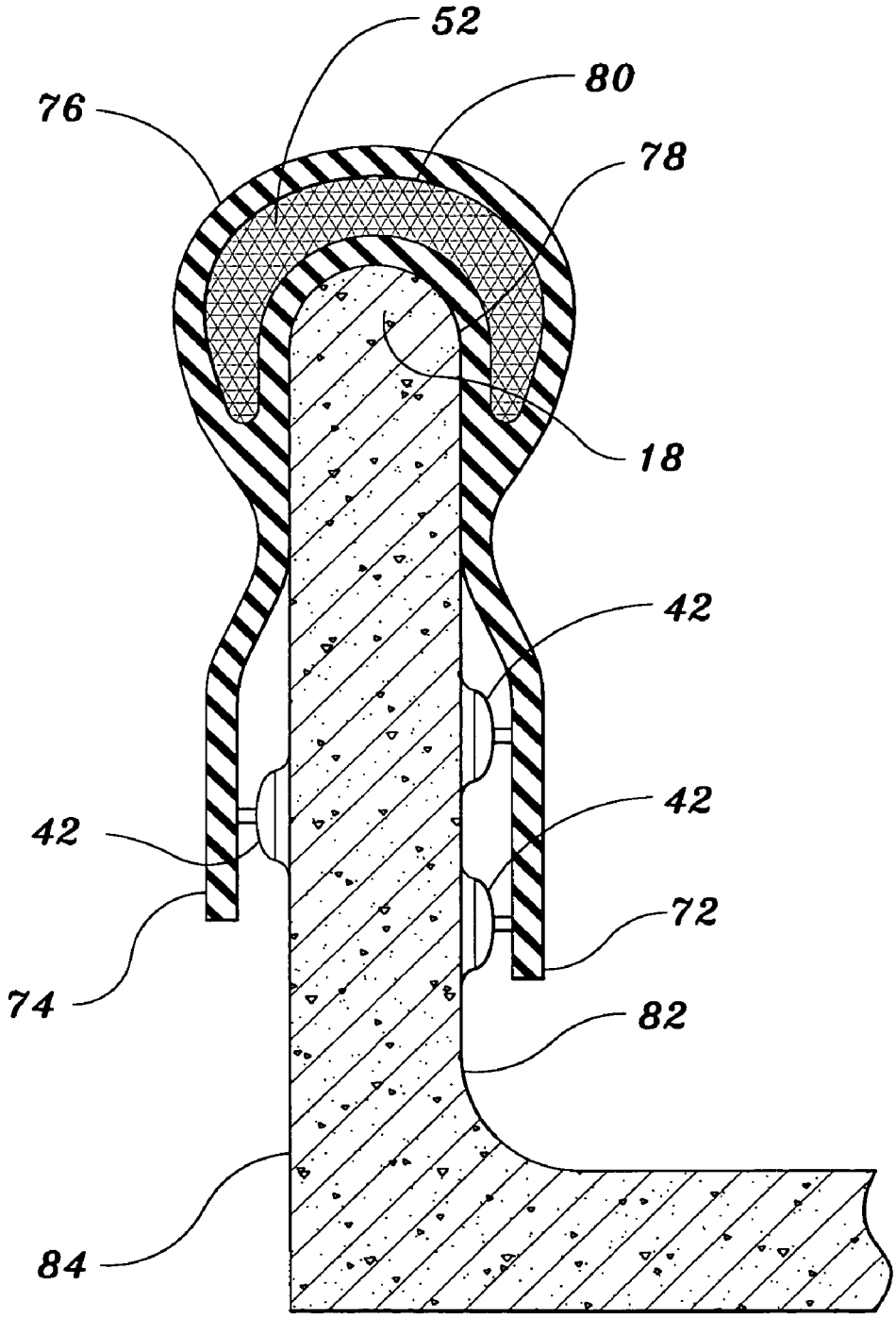
FIG. 5 is an environmental vertical sectional view of a bathtub cushion according to the present invention, showing the bathtub cushion disposed over the edge of a bathtub.

FIG. 5 shows another alternative embodiment of the cushion as it would be used on a bathtub edge 18. As with the pool cushion, the bathtub cushion is a padded mat having a first end 72, a second end 74, a top surface 76, and a bottom surface 78. A cavity 80 is created within the cushion between top surface 76 and bottom surface 78 and extends along substantially the entire width of the cushion. Cavity 80 is filled with a pliable structural support member 52. The cushion is placed over the edge 18 of the bathtub so that structural support member 52 completely encompasses bathtub edge 18. The support member 52, preferably a wire mesh, allows the cushion to conform to an edge of any shape. Additional padding may be disposed within the cavity 80, if desired.

Both the first end 72 and the second end 74 of the cushion are provided with a plurality of suction cups 42 extending from bottom surface 78 of the cushion. Suction cups 42 are used to secure first end 72 to the interior wall 82 of the bathtub and second end 74 to the exterior wall 84 of the bathtub.

The body of both the pool cushion and the bathtub cushion are made from a resilient padding material, such as rubber or foam rubber.

It is to be understood that the present invention is not limited to the embodiments described above, but encompasses any and all embodiments within the scope of the following claims.

I claim:

1. A pool cushion for cushioning a portion of a swimming pool edge, comprising:

an elongated flat body made of resilient padding material, the body having a first end adapted for retaining the body in a fixed position along a periphery of the pool, a second end adapted for being affixed to an interior wall of the pool, a top surface, a bottom surface, and a cavity formed between the top surface and the bottom surface and extending substantially the entire width of the body; and a pliable structural support member disposed within the cavity for conforming the body to the pool edge shape, wherein the structural support member comprises wire mesh.

2. The pool cushion according to claim 1, further comprising a plurality of suction cups extending from the bottom surface proximate the second end for attaching the second end of the body to the interior wall of the pool.

3. The pool cushion according to claim 2, wherein the first end has a plurality of apertures defined therein adapted for receiving fasteners therethrough to retain the body in a fixed position along the periphery of the pool.

4. The pool cushion according to claim 2, wherein the body has a second cavity formed therein substantially adjacent the first end and extending substantially the entire width of the body, the pool cushion further comprising a densely weighted material disposed in the second cavity for anchoring the body in a fixed position along the periphery of the pool.

5. The pool cushion according to claim 1, further comprising means for interlocking a plurality of said bodies to cover the entire peripheral edge of the pool.

6. The pool cushion according to claim 1, wherein the body is made of foam rubber.

7. A padded cushion for covering a peripheral edge of a water reservoir, comprising:

an elongated flat cushion body made of resilient padding material having an exterior attachment side for attachment to an exterior of the reservoir, an interior attachment side for attachment to an interior of the reservoir, opposing first and second ends, and a cavity formed therein extending substantially the entire length of the body, wherein one of the opposing ends has a plurality of recesses defined therein and the end opposite the recesses has a plurality of interlocking fingers projecting therefrom, whereby a plurality of cushion bodies are connected around the periphery of the reservoir by interlocking fingers and recesses of adjacent cushion bodies; and a pliable structural support member disposed within the cavity for conforming the cushion body to the reservoir edge shape.

8. The padded cushion according to claim 7, wherein said cushion body is made of foam rubber.

9. The padded cushion according to claim 7, wherein said structural support member comprises wire mesh.

10. The padded cushion according to claim 7, further comprising a plurality of suction cups disposed along the interior attachment side of said cushion body for attaching the interior attachment side to an interior wall of the reservoir.

11. The padded cushion according to claim 7, further comprising a plurality of suction cups disposed along the exterior attachment side of said cushion body for attaching the exterior attachment side to an exterior of a bathtub.

12. The padded cushion according to claim 7, wherein the exterior attachment side has a plurality of apertures defined therein adapted for receiving an anchor therethrough selected from the group consisting of a stake, a hook, and a fastener.

13. The padded cushion according to claim 7, wherein said cushion further comprises a densely weighted material disposed along the exterior attachment side for anchoring the exterior attachment side along the periphery of the reservoir.

14. A bathtub cushion for cushioning a portion of a bathtub edge, comprising:

an elongated flat body made of resilient padding material, the body having a first end adapted for retaining the body in a fixed position along a periphery of the pool, a second end adapted for being affixed to an interior wall of the pool, a top surface, a bottom surface, and a cavity formed between the top surface and the bottom surface and extending substantially the entire width of the body; and a pliable structural support member disposed within the cavity for conforming the body to the pool edge shape, wherein the structural support member comprises wire mesh;

a first plurality of suction cups extending from the bottom surface proximate the first end for affixing the first end of the body along an inside wall of the bathtub; and a second plurality of suction cups extending from the bottom surface proximate the second end for affixing the second end of the body along an outside wall of the bathtub.

15. The bathtub cushion according to claim 14, further comprising means for interlocking a plurality of said bodies together around the periphery of the bathtub.

16. The bathtub cushion according to claim 14, wherein the body is made of foam rubber.

* * * * *